US006250258B1

(12) United States Patent
Liebig

(10) Patent No.: US 6,250,258 B1
(45) Date of Patent: Jun. 26, 2001

(54) METHOD FOR STARTING UP A ONCE-THROUGH HEAT RECOVERY STEAM GENERATOR AND APPARATUS FOR CARRYING OUT THE METHOD

(75) Inventor: Erhard Liebig, Laufenburg (DE)

(73) Assignee: ABB Alstom Power ( Schweiz) AG, Baden (CH)

( * ) Notice: Subject to any disclaimer, the term of this patent is extended or adjusted under 35 U.S.C. 154(b) by 0 days.

(21) Appl. No.: 09/499,397

(22) Filed: Feb. 7, 2000

(30) Foreign Application Priority Data

Feb. 22, 1999 (DE) ..... 199 07 451

(51) Int. Cl.[7] ..... F22D 7/00
(52) U.S. Cl. ..... 122/406.5; 122/1 B; 122/451 S
(58) Field of Search ..... 122/1 B, 406.4, 122/406.5, 448.4, 451 S

(56) References Cited

U.S. PATENT DOCUMENTS

| | | | | |
|---|---|---|---|---|
| 3,120,839 | * | 2/1964 | Glahe | 122/406.5 |
| 3,259,111 | * | 7/1966 | Koch | 122/406.4 |
| 4,262,636 | * | 4/1981 | Augsburger | 122/1 B |
| 4,290,390 | * | 9/1981 | Juzi | 122/406.4 |
| 4,487,166 | * | 12/1984 | Haller et al. | 122/406.5 |
| 5,839,396 | * | 11/1998 | Franke et al. | 122/406.5 |

FOREIGN PATENT DOCUMENTS

| | | |
|---|---|---|
| 1228623 | 11/1966 | (DE) . |
| 1230037 | 12/1966 | (DE) . |
| 1290940 | 3/1969 | (DE) . |
| 1299642 | 7/1969 | (DE) . |

* cited by examiner

*Primary Examiner*—Gregory Wilson
(74) *Attorney, Agent, or Firm*—Burns, Doane, Swecker & Mathis, L.L.P.

(57) ABSTRACT

A separator (8) is arranged downstream of the superheater section (4) of the once through heat recovery steam generator (1). A branch line (9) running to the separator (8) is branched off from an outflow line (5) running from the superheater section (4) to the steam turbine (6). An outflow line (11) for separated water runs from the separator (8) to the once through heat recovery steam generator (1). The steam separated in the separator (8) can flow through a bypass line (13) to the condensor/hotwell (14). For starting up the once through heat recovery steam generator (1), the latter is filled with water, the water is loop-circulated through the separator (8) and the outflow line (11) in the once through heat recovery steam generator (1) or water steam cycle and the supply of heat is initiated. In this case, the main shutoff member (7) upstream of the steam turbine (6) is closed, and the branch shutoff member (10) in the branch line (9) upstream of the separator (8) is open. When the formation of steam commences, the latter flows out of the separator (8) through the bypass line (13) to the condenser (14). When the steam conforms to the requirements of the steam turbine (6), the main shutoff member (7) is opened and the branch shutoff member (10) closed, thus ensuring an early start-up of the steam turbine (6).

18 Claims, 4 Drawing Sheets

METHOD FOR STARTING UP A ONCE-THROUGH HEAT RECOVERY STEAM GENERATOR AND APPARATUS FOR CARRYING OUT THE METHOD

FIELD OF THE INVENTION

The invention relates to a method and apparatus for operating a steam generation plant having a steam turbine, and more specifically to a method and apparatus for starting up a once through heat recovery steam generator which is connected to a steam consumer within a working-fluid-cycle.

BACKGROUND OF THE INVENTION

The invention relates, further, to a once through heat recovery steam generator connected to a steam consumer within a water steam cycle and having an evaporator and at least one superheater section for carrying out the method.

In power stations having a steam generation plant and a steam turbine, the aim in the first place is generally to achieve short start-up times, irrespective of whether a steam power station pure and simple or a combined cycle plant is concerned. What is critical is the duration until steam meeting the requirements of the steam turbine is available under stable conditions at the boiler outlet. Known designs of boilers conform to these requirements only inadequately.

The start-up of the boiler and steam turbine in connection with combined cycle power stations utilizing the exhaust-gas heat of the gas turbine for steam generation in the heat recovery steam generator is particularly important. Gas turbines are nowadays capable of running up from the cold state to the rated-load mode in markedly less than one hour.

Heat recovery steam generators with a circulation-type drum evaporator can often follow such rapid thermal loading to only a restricted extent because of the thick-walled components of the drum. Heat recovery steam generators on the principle of the once-through evaporator, with a separator between the evaporator and superheater, can achieve stable operating states even at medium pressures of up to about 80 bar. However, due to the superheaters connected downstream of the separator, the temperatures at the outlet of the heat recovery steam generator are too high for rapid start-up of a steam turbine.

The time for starting up a steam turbine nevertheless depends essentially on the steam temperatures. The lower the steam temperature can be maintained during start-up, the more rapidly the steam turbine can be started up. The object, for this reason, is to develop heat recovery steam generators, in combination with water steam cycles, which follow the gas turbine without delay during start-up, reach stable operating states quickly and supply the steam turbine at an early stage with steam at low temperatures for the start-up.

BRIEF SUMMARY OF THE INVENTION

The object on which the invention is based is to provide a method of the type initially mentioned which allows a short start-up time for a steam consumer. Another object is to provide a once through heat recovery steam generator or a water steam cycle for carrying out the method.

According to the invention, this is achieved by the arrangement of a separator within the heat recovery steam generator downstream of the at least one superheater section or in the working-fluid-cycle, said separator making it possible that, prior to the start-up, the heat recovery steam generator or the working-fluid-cycle is filled with the working medium in the liquid state up to the separator, that the liquid phase of the working medium is loop-circulated in the heat recovery steam generator or in the working-fluid-cycle and the supply of heat is subsequently initiated, and that, after the formation of steam has commenced, separation is carried out between the vaporous phase and the liquid phase of the working medium downstream of said superheater section in the separator, the liquid phase is further loop-circulated and the steam is conducted to a tank. When the requirements of the steam consumer are achieved, the supply of the steam to said tank is prevented and the steam is supplied to the steam consumer.

According to the invention, the superheater heating surfaces, which otherwise remain dry for a long time and therefore uncooled, may be used at least partially for preheating and evaporating the heat transfer medium during the start-up.

A once through heat recovery steam generator, connected to a steam consumer and having at least one superheater section, and a corresponding water steam cycle, for carrying out the method, are distinguished by a separator which is arranged downstream of the at least one superheater section in the direction of run of the working medium flowing through the heat recovery steam generator or the water steam cycle.

BRIEF DESCRIPTION OF THE DRAWINGS

Preferred embodiments of the invention are described herein, and are illustrated in the accompanying drawings in which.

DETAILED DESCRIPTION OF THE INVENTION

Figure 1:
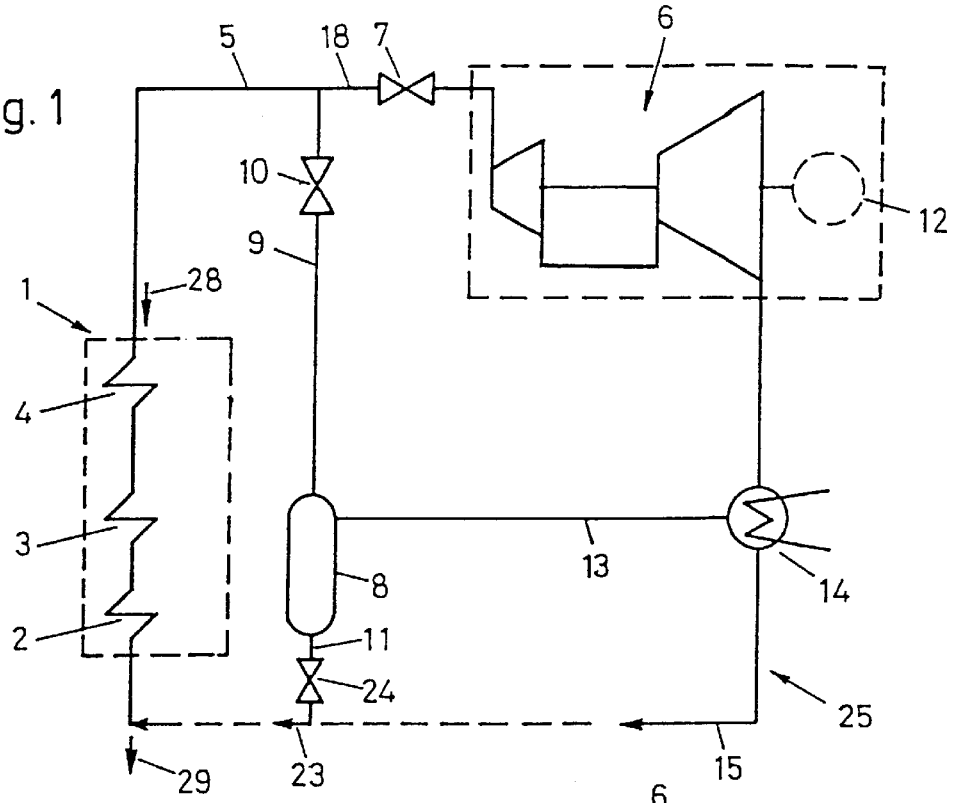
FIG. 1 is a schematic circuit diagram of a first embodiment of the invention.

Only the elements that are necessary for the understanding of the invention are illustrated in the drawings. Like elements are designated by the same reference number in all the figures.

FIG. 1 shows, purely diagrammatically, a water steam cycle 25 with a once through heat recovery steam generator 1, for example located downstream on the exhaust-gas side of a gas turbine for exhaust-gas heat utilization, with the heating gas inlet 28 and the heating gas outlet 29. However, the once through heat recovery steam generator 1 may also be located downstream of other waste-heat intensive processes for waste-heat utilization. The once through heat recovery steam generator 1 includes an economizer section 2, an evaporator section 3 and a superheater section 4. An outflow line 5, followed by a connecting line 18, goes from the superheater section 4 to the steam turbine 6 which is coupled to a generator 12, a main shutoff member 7 being arranged in said connecting line 18.

A branch line 9, which runs to a separator 8 and in which a branch shutoff member 10 is arranged, branches off, upstream of the main shutoff member 7, from the outflow line 5.

The separator 8 has connected to it an outflow line 11 with a control element 24 for discharging the separated liquid phase of the working medium, here water. The control element 24 located in the outflow line 11 serves, in combination with a level indicator, not illustrated, in the separator 8, for regulating the level in the separator 8. As suggested by the line 23, the water flowing through the outflow line 11 is recirculated to the once through heat recovery steam generator 1. The water flowing through the outflow line 11 may, before entering the once through heat recovery steam generator 1, flow through various components, not illustrated, of the water steam cycle 25, such as, for example, heat exchangers, pumps, valves, etc.

Furthermore, a bypass line 13 extends from the separator 8 to the condenser/hotwell 14. Where the present bypass concept is concerned, any reheater would not have steam flowing through it in the bypass mode, that is to say would not be cooled, since the fresh steam is diverted directly into the condenser/hotwell 14. Connected to the condenser/hotwell 14 is the condensate/feedwater line 15, via which the condensate/feedwater is recirculated to the once through heat recovery steam generator 1.

In this case, too, the condensate/feedwater may, before entering the once through heat recovery steam generator 1, flow through various components, not illustrated, of the water steam cycle 25, such as, for example, pumps, heat exchangers, valves, etc.

At the commencement of the start-up of the once through heat recovery steam generator 1, the system is filled with water up to the separator 8, that is to say the superheater section 4 is also filled with water.

By means of the control element 24 and the level regulation present in the separator 8, however, a predetermined level range is maintained during filling, for example even during the start-up.

The main shutoff member 7 in the connecting line 18 is closed, and the branch shutoff member 10 in the branch line 9 is open.

Subsequently, via pump units not illustrated any further, the circulation mode via the once through heat recovery steam generator 1 and the separator 8 is initiated, before the supply of heat to the once through heat recovery steam generator 1 commences by putting into operation a gas turbine, in the case of a combined cycle power station, or by putting into operation any other process delivering exhaust gas at a high temperature level.

The water which heats up in the once through heat recovery steam generator 1 flows in closed circuit through the outflow line 5 and the branch line 9 into the separator 8 and thereafter through the outflow line 11 back to the once through heat recovery steam generator 1. An absorption of heat by the water thus also takes place in the superheater section 4 of the once through heat recovery steam generator 1.

When the formation of steam commences, the separation of water and steam takes place in the separator 8. The water is recirculated to the once through heat recovery steam generator 1 and the steam is supplied through the bypass line 13 to the condenser/hotwell 14 and is condensed there, in order likewise to be conveyed back to the once through heat recovery steam generator 1 as condensate or feedwater.

From a particular moment on, only steam flows in the outflow line 5. However, the bypass mode through the bypass line 13 is maintained until the steam flowing in the outflow line 5 conforms to the requirements of the steam turbine 6.

When the steam conforms to the requirements of the steam turbine 6, the main shutoff member 7 is opened and the branch shutoff member 10 closed, so that the steam turbine 6 can be started up.

According to the invention, during the start-up, the superheater 4 is first operated as an economizer for preheating, after the saturation conditions are reached is operated as an evaporator and is operated as a superheater only after being subjected to saturated steam. The fresh-steam temperature at the outlet of the superheater is regulated via the feedwater mass flow at the inlet of the once through heat recovery steam generator 1, the evaporation end point being displaced within the heating surfaces. As a result, steam temperatures can be run under stable conditions at the superheater outlet with only slight superheating, thus ultimately allowing an early and rapid start of the steam turbine.

Since the outlet temperature at the once through heat recovery steam generator 1 is identical to the inlet temperature at the steam turbine 6, the steam turbine can be started up with saturated steam in the limiting case. In this case, the evaporation end point is at the end of the superheater heating surfaces.

In the following figures, the same plants or components and the same methods, such as, for example, the circulation mode at the commencement of a start-up operation, will not be explained again.

Figure 2:
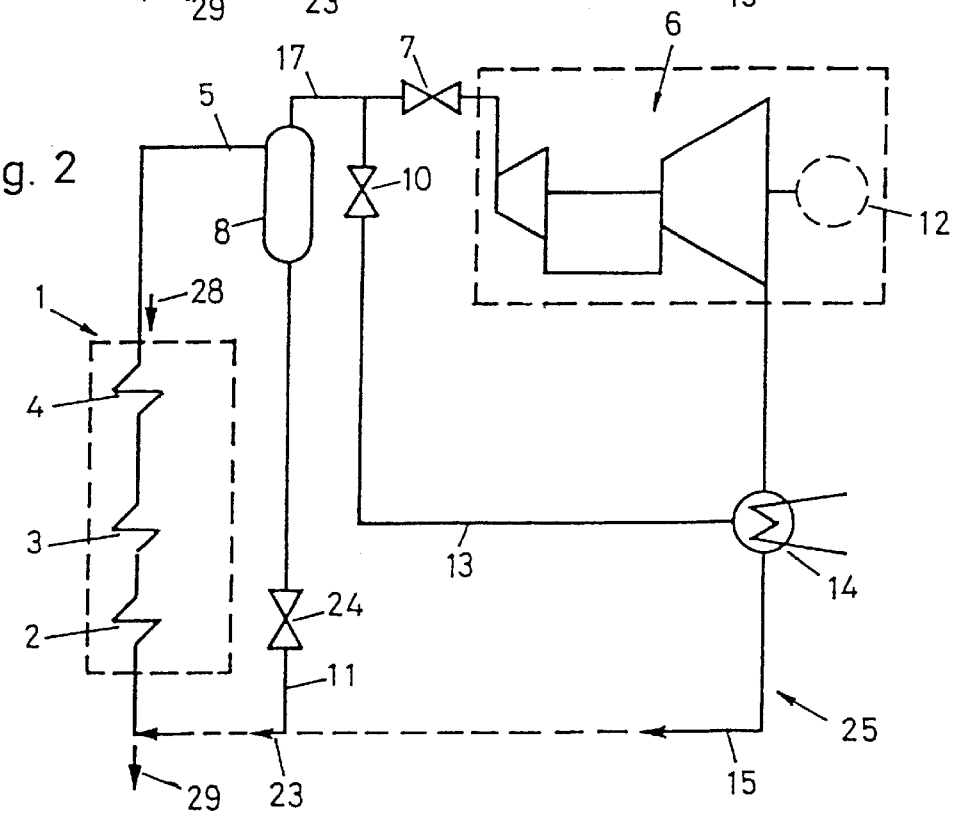
FIG. 2 is a schematic circuit diagram of a second embodiment of the invention.

FIG. 2 shows a version according to which the outflow line 5 runs directly to the separator 8.

A steam line 17, in which the main shutoff member 7 is arranged, runs to the steam turbine 6 from the separator 8. Furthermore, the line for separated water, defined as the outflow line 11, is connected to the separator 8, the water being recirculated to the once through heat recovery steam generator 1 through said outflow line 11, as suggested by the arrow in the line 23. The bypass line 13, in which the branch shutoff member 10 is arranged, branches off upstream of the main shutoff member 7, said bypass line 13 running to the condenser/hotwell 14.

During the start-up of the once through heat recovery steam generator 1, steam flows through the steam line 17 only after evaporation has commenced. As long as the state of the steam does not meet the requirements of the steam turbine 6, the main shutoff member 7 is closed and the branch shutoff member 10 is open, so that the bypass mode is in operation.

After the steam flowing through the steam line 17 meets the requirements of the steam turbine 6, the main shutoff member 7 is opened and the branch shutoff member 10 closed, with the result that the steam can flow to the steam turbine 6 and the latter is started up.

In the present case, due to the arrangement of the separator 8 within the water steam cycle, the steam turbine 6 can be started up with saturated steam even when the once through heat recovery steam generator 1 delivers only wet steam at the outlet.

Figure 3:
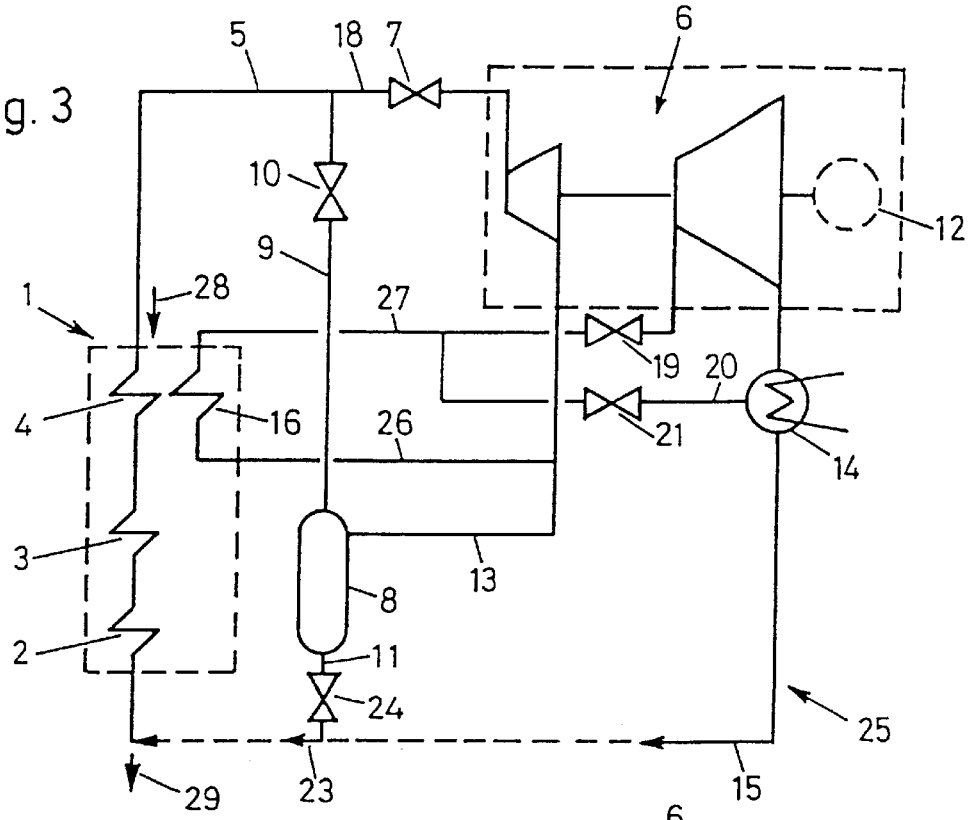
FIG. 3 is a schematic circuit diagram of the invention according to FIG. 1, and which steam is supplied to the condenser/hotwell by an reheater.

The arrangement of the separator according to the version shown in FIG. 3 is identical to the arrangement according to FIG. 1. Here, however, the bypass line 13 does not run directly to the condenser/hotwell 14, but into the cold reheat line 26 leading to the reheater 16. The hot reheat line 27, in which a low-pressure shutoff member 19 is arranged, extends from the hot end of the reheater 16 to the low-pressure part of the steam turbine 6. A bypass line 20 having a bypass shutoff member 21 branches off from the hot reheat line 27, said bypass line 20 running to the condenser/hotwell 14. Thus, in this version with a cooled reheater, the fresh steam generated in the bypass mode is diverted into the condenser/hotwell 14 via the reheater 16. The control of the shutoff members 7, 10, 19 and 21 is carried out according to the same method as in the versions described above. The shutoff members 7, 19 are opened and the shutoff members 10, 21 closed as soon as the steam conforms to the requirements of the steam turbine 6.

Figure 4:
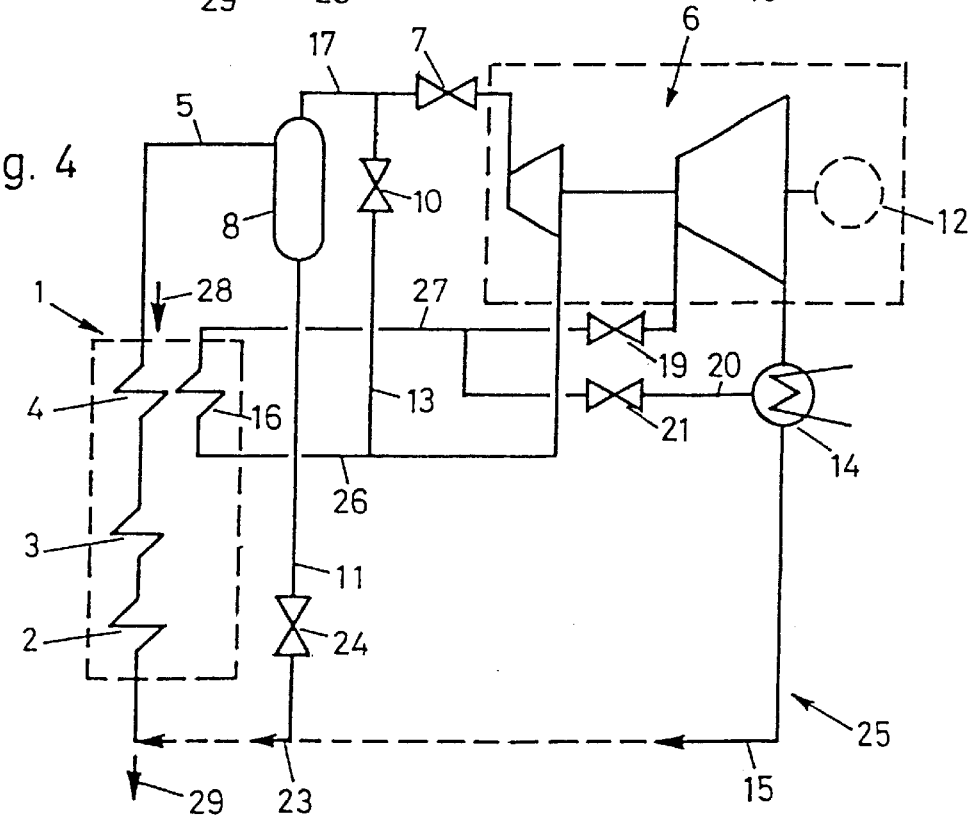
FIG. 4 is a schematic circuit diagram of the invention according to FIG. 2, in which steam is supplied to the condenser/hotwell by an reheater.

The arrangement of the separator 8 according to the version shown in FIG. 4 corresponds to that of FIG. 2. However, in the version according to FIG. 4, the steam flows through the reheater 16 in the bypass mode in a similar way to the version according to FIG. 3. The start-up method corresponds to that of the version according to FIG. 3 and therefore does not have to be described again.

Figure 5:
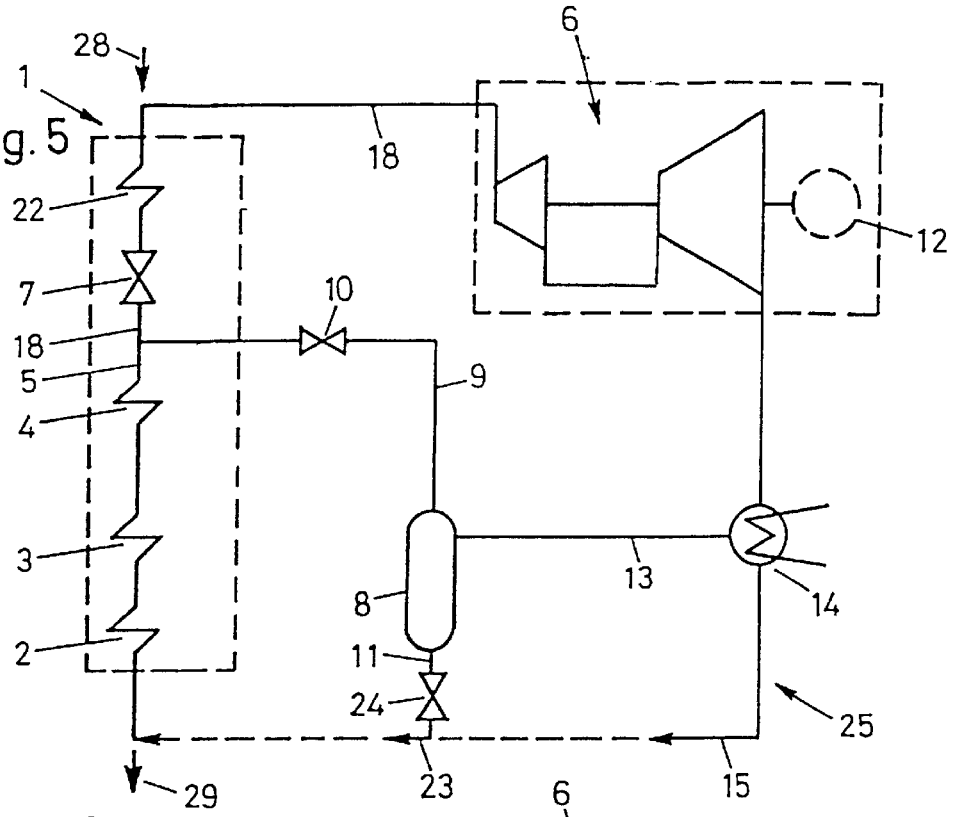
FIG. 5 is a schematic circuit diagram of the invention according to FIG. 1, with two superheater sections.

In the version according to FIG. 5, there are two superheater sections 4 and 22 in the once through heat recovery steam generator 1. The branch line 9 having the branch shutoff member 10 and running to the separator 8 is branched off at a point between the first superheater section 4 and the main shutoff member 7 which is arranged upstream of the second superheater section 22. The steam flows from the second superheater section 22 to the steam turbine 6 in a similar way to the previous versions.

The start-up takes place in the same way as the method described with reference to FIG. 1, with the exception that in the bypass mode, that is to say until a steam conforming to the requirements of the steam turbine 6 is present, the second superheater section 22 does not have steam flowing through it and is consequently not cooled. That is to say, when the third branch shutoff member 10 is closed and the main shutoff member 7 opened, heat is additionally supplied by the second superheater section 22 to the steam flowing to the steam turbine 6, with the result that this steam is additionally superheated.

Figure 6:
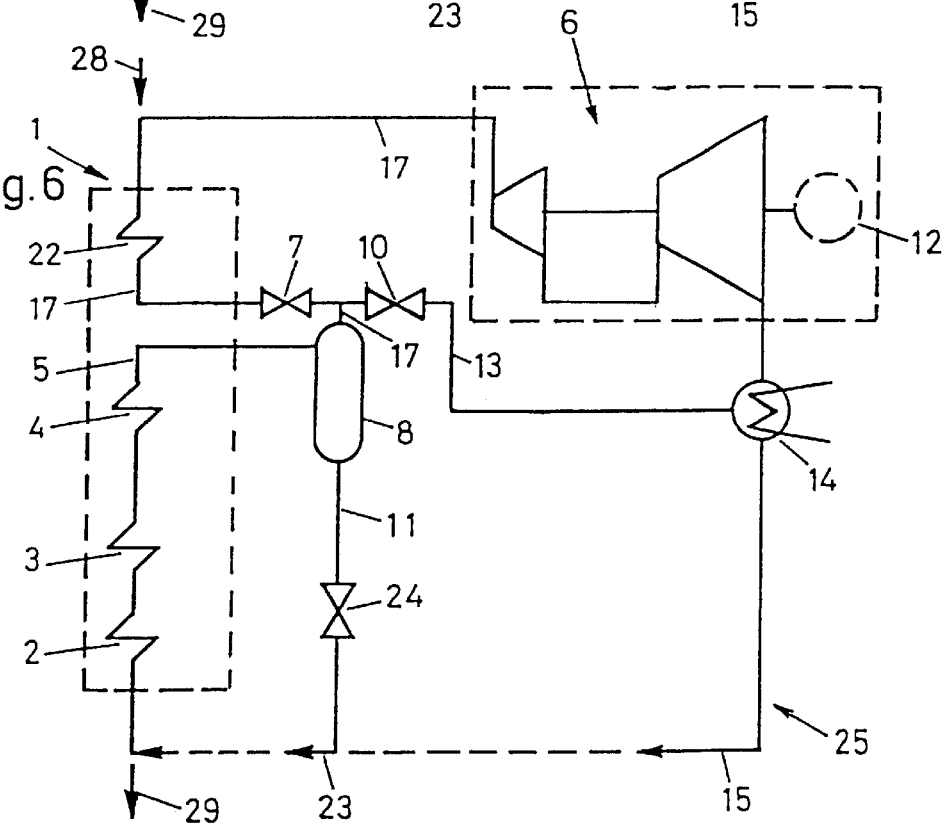
FIG. 6 is a schematic circuit diagram of the invention according to FIG. 2, with two superheater sections.

FIG. 6 likewise shows a version with a once through heat recovery steam generator 1 which has two superheater sections 4 and 22, the separator 8 being arranged between the first superheater section 4 and the second superheater section 22 with respect to the direction of throughflow of the steam. The start-up takes place in a similar way to the version according to FIG. 2, but with the exception that heat is further supplied by the second superheater section 22 to the steam flowing through the separator 8 before said steam enters the steam turbine 6.

Figure 7:
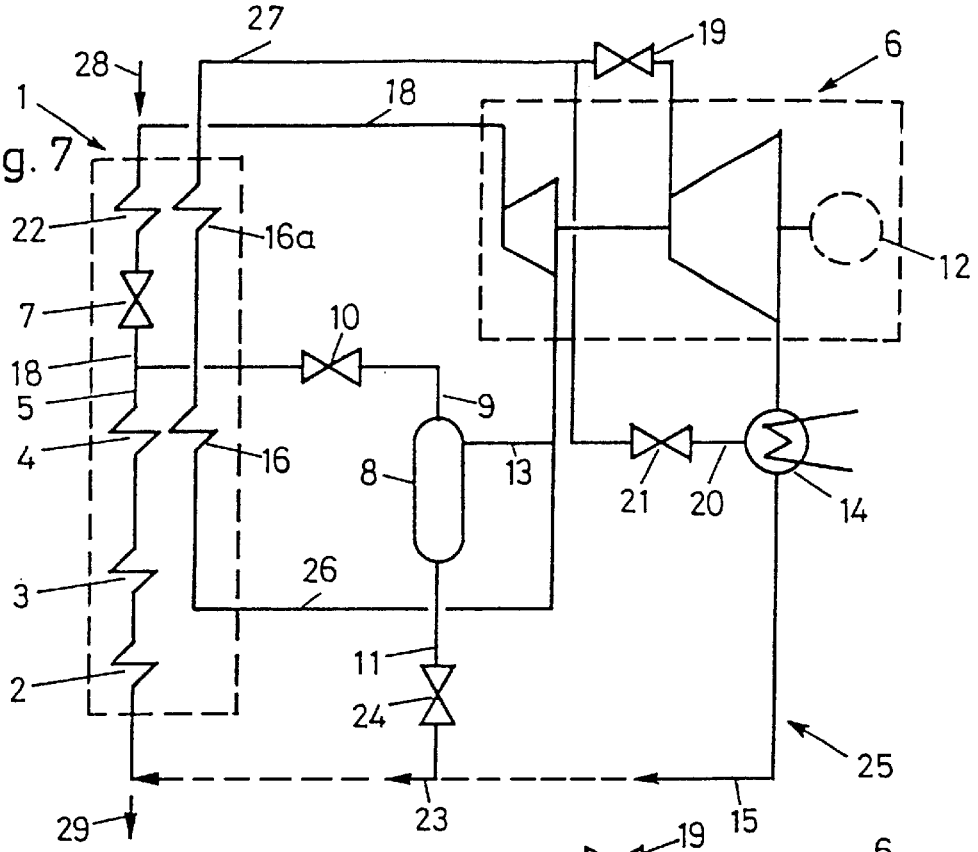
FIG. 7 is a schematic circuit diagram of the invention according to FIG. 3, with two superheater sections.

The version according to FIG. 7 is comparable to that of FIG. 3. That is to say, in the bypass mode, steam flows through the reheater 16, 16*a*. The branch line 9 having the branch shutoff member 10 branches off in a similar way to FIG. 5 between the first superheater section 4 and the second superheater section 22 and upstream of the main shutoff member 7. Here too, during the start-up of the steam turbine 6, heat is additionally supplied to the steam by the second superheater section 22.

Figure 8:
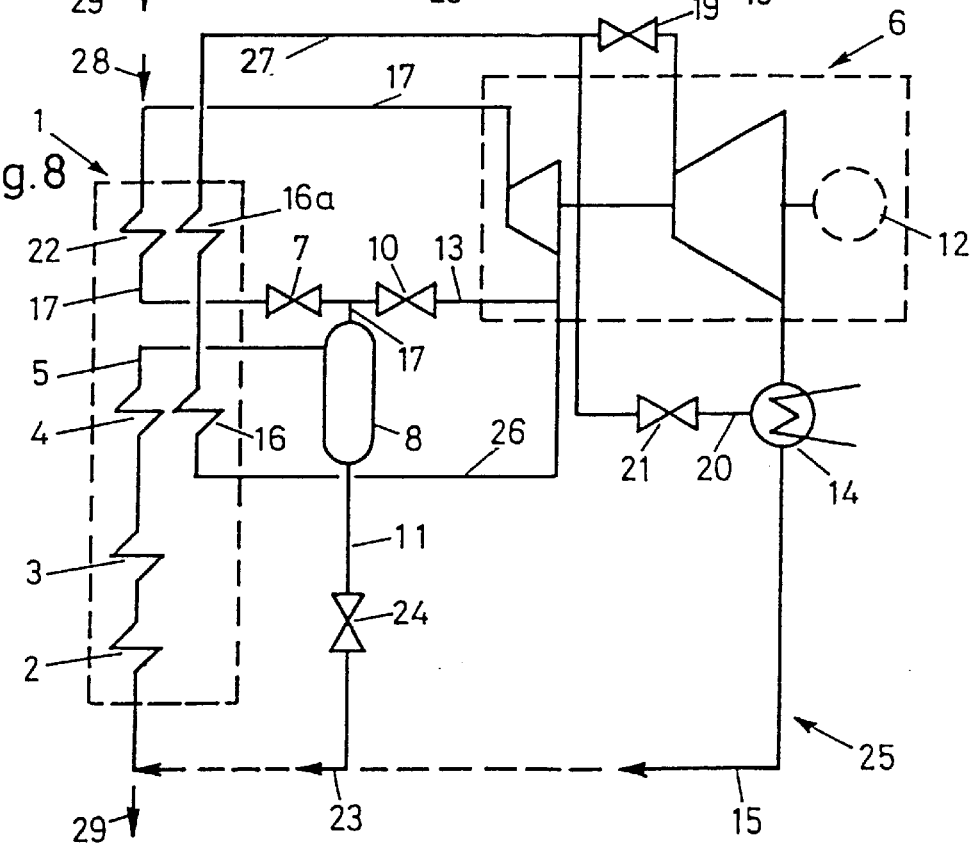
FIG. 8 is a schematic circuit diagram of the invention according to FIG. 4, with two superheater sections.

The version according to FIG. 8 has, again, two superheater sections 4 and 22, the steam being supplied to the separator 8 through the line 5 downstream of the first superheater 4 in a similar way to the version according to FIG. 6. In the bypass mode, the steam is supplied to the condenser/hotwell 14 by the reheater 16, 16*a*. When the generation of steam commences, the shutoff members 7 and 19 are initially still closed and the shutoff members 10 and 21 open, so that the bypass mode takes place via the reheater 16, 16*a*. When the steam reaches parameters which meet the requirements of the steam turbine 6, the shutoff members 7 and 19 are opened and the shutoff members 10 and 21 closed, so that steam flows from the second superheater section 22 to the steam turbine, heat additionally being supplied to the steam by the second superheater section 22.

It may be noted in conclusion, as regards the bypasses, that these must, at their outlet, provide steam conditions which conform to the conditions at the steam inlets in the cold intermediate superheating line 26 (bypass concept with a cooled reheater) or in the condenser 14 (bypass concept with an uncooled reheater). In the bypasses, therefore, there are pressure reductions and water injections which are not depicted for the sake of clarity, since they have no bearing on the concept of the invention.

What is claimed is:

1. A method for starting up a once through heat recovery steam generator which is connected to a steam consumer within a working-fluid-cycle and which has an evaporator and at least one superheater section, and including a separator, the method comprising: filling the once through heat recovery steam generator and the separator with a working medium in the liquid phase, loop-circulating the liquid phase of the working medium in the once through heat recovery steam generator, subsequently initiating the supply of heat to cause the formation of a vaporous phase of the working medium, after the formation of steam has commenced, separating the vaporous phase and the liquid phase of the working medium downstream of said superheater section in the separator, and the liquid phase from the separator is further loop-circulated and the vaporous phase is conducted to a tank.

2. The method as claimed in claim 1, including supplying the vaporous phase the steam consumer are achieved, while the supply of the steam to said tank is prevented.

3. The method as claimed in claim 1, the once through heat recovery steam generator having a first superheater section and a second superheater section following the first, wherein the separation of the liquid phase and of the vaporous phase of the working medium takes place in a line between the first and the second superheater section of the once through heat recovery steam generator.

4. The method as claimed in claim 1, wherein the separation of the liquid phase and of the vaporous phase of the working medium takes place in a line between the once through heat recovery steam generator and the tank.

5. The method as claimed in claim 1, the separation of the liquid phase and of the vaporous phase of the working medium takes place in a line between the once through heat recovery steam generator and the steam consumer.

6. The method as claimed in claim 1, wherein the once through heat recovery steam generator has a reheater and the separation of the liquid phase and of the vaporous phase of the working medium takes place in a line to the reheater.

7. The method as claimed in claim 1, wherein the steam consumer is a steam turbine and the tank is a condenser/hotwell following the steam turbine.

8. The method as claimed in claim 1, wherein the once through heat recovery steam generator has a reheater and until the requirements of the steam consumer are achieved, the steam generated is supplied first to the reheater and subsequently to the tank.

9. A water and steam cycle, comprising a once through heat recovery steam generator and a steam consumer, the water and steam cycle having at least one first superheater section, with an outflow line for receiving the working fluid flowing out of the at least one superheater section and including a steam and water separator which is arranged downstream from the at least one superheater section in the direction of run of the working fluid flowing through the once through heat recovery steam generator and, the water and steam cycle including a main shutoff member arranged upstream of the steam consumer, for shutting off a supply of the working fluid to the steam consumer, and including a branch shutoff member arranged downstream of the at least one superheater section in a branch line, said shutoff members being alternately in the open and closed position according to the operating mode of the water and steam cycle.

10. The water and steam cycle as claimed in claim 9, wherein the separator has connected to it an outflow line leading back to the once through heat recovery steam generator and having a control element for the separated liquid phase and a line for the separated steam phase.

11. The water and steam cycle as claimed in claim 10, wherein one of the lines runs as a bypass line directly from the separator to a hotwell and include a condensate/feedwater line running from said hotwell back to the once through heat recovery steam generator.

12. The water and steam cycle wherein as claimed in claim 10, wherein a cold reheat line running to a reheater is connected to one of the lines for the separated steam phase.

13. The water and steam cycle as claimed in claim 12, where a bypass line is branched off from the hot reheat line of the reheater, said bypass line running to a and including a condensate/feedwater line running from said hotwell back to the once through heat recovery steam generator.

14. The water and steam cycle as claimed in claim 10, wherein the once through heat recovery steam generator has a first superheater section and a second superheater section following the first, include a steam line for the separated steam phase that opens into the once through heat recovery steam generator at a point in the once through heat recovery steam generator between the first and the second superheater sections.

15. The water and steam cycle as claimed in claim 9, wherein the branch line is branched off from the outflow line and runs to the separator.

16. The water and steam cycle as claimed in claim 9, wherein the branch line is branched off from the line for the separated steam phase.

17. The water and steam cycle as claimed in claim 9, wherein the once through heat recovery steam generator has a first superheater section and a second superheater section following the first, and the branch line is branched off from the outflow line at a point between the first and the second superheater sections.

18. The water and steam cycle as claimed in claim 9, wherein the steam consumer is a steam turbine and the receives steam from the steam turbine.

* * * * *